US009965951B1

(12) United States Patent
Gallagher et al.

(10) Patent No.: US 9,965,951 B1
(45) Date of Patent: May 8, 2018

(54) COGNITIVE TRAFFIC SIGNAL CONTROL

(71) Applicant: International Business Machines Corporation, Armonk, NY (US)

(72) Inventors: John B. Gallagher, Bibra Lake (AU); Bradley M. Gorman, Clarkson (AU); Cody S. Gough, Harrisdale (AU); Stephen J. Hobson, Hampton (GB); Mohammad B. Zanjani, Perth (AU)

(73) Assignee: International Business Machines Corporation, Armonk, NY (US)

( * ) Notice: Subject to any disclaimer, the term of this patent is extended or adjusted under 35 U.S.C. 154(b) by 0 days. days.

(21) Appl. No.: 15/412,153

(22) Filed: Jan. 23, 2017

(51) Int. Cl.
*G08G 1/095* (2006.01)
*G08G 1/081* (2006.01)
*G08G 1/01* (2006.01)

(52) U.S. Cl.
CPC ..... *G08G 1/081* (2013.01); *G08G 1/0141* (2013.01); *G08G 1/0145* (2013.01)

(58) Field of Classification Search
CPC ..... G08G 1/07; G08G 1/08; G08G 1/081; G08G 1/087; G08G 1/005; G08G 1/0145; G08G 1/01–1/0116
USPC ..... 340/907, 909–911, 914, 933, 937; 701/117–119
See application file for complete search history.

(56) References Cited

U.S. PATENT DOCUMENTS 6,317,058 B1 * 11/2001 Lemelson ..... G08G 1/07 340/914
8,666,643 B2 3/2014 McBride et al.
9,633,560 B1 * 4/2017 Gao ..... G08G 1/07
2006/0181433 A1 * 8/2006 Wolterman ..... G08G 1/08 340/933
2008/0086258 A1 * 4/2008 Wall ..... G08G 1/081 701/117

(Continued)

FOREIGN PATENT DOCUMENTS

CN 203311637 U 11/2013

OTHER PUBLICATIONS

Choudekar et al., "Real Time Traffic Light Control Using Image Processing", Indian Journal of Computer Science and Engineering (IJCSE), ISSN : 0976-5166, vol. 2 No. 1, 5 pages, printed on Oct. 13, 2016.

(Continued)

*Primary Examiner* — Thomas Mullen
(74) *Attorney, Agent, or Firm* — Christopher McLane

(57) ABSTRACT

In an approach for adapting traffic signal timing, a computer receives a streaming video for one or more paths of a first intersection. The computer identifies traffic within the received streaming video. The computer calculates traffic flow for the one or more paths of the first intersection based on the identified traffic. The computer determines whether a change in a state of a traffic signal for the first intersection should occur based at least in part on the identified traffic and the determined traffic flow with respect to predefined objectives. Responsive to determining the change in the state of the traffic signal for the first intersection should occur, the computer calculates a change to a traffic signal timing based on the determined change in the state of the traffic signal. The computer initiates an adaptation to the traffic signal timing based on the determined change to the traffic signal timing.

20 Claims, 3 Drawing Sheets

(56) References Cited

U.S. PATENT DOCUMENTS

| | | | | |
|---|---|---|---|---|
| 2014/0307087 | A1* | 10/2014 | Evanitsky | G08G 1/164 348/143 |
| 2014/0375475 | A1 | 12/2014 | Wongpiromsarn et al. | |
| 2015/0134232 | A1 | 5/2015 | Robinson | |
| 2015/0243164 | A1* | 8/2015 | Collum | G08G 1/07 340/916 |
| 2016/0247401 | A1* | 8/2016 | Nguyen | G08G 1/07 |
| 2017/0089717 | A1* | 3/2017 | White | G08G 1/0112 |
| 2017/0154525 | A1* | 6/2017 | Zou | G08G 1/08 |

OTHER PUBLICATIONS

"Tradeoff Analytics", IBM Watson Developer Cloud, © 2016 IBM, printed on Oct. 13, 2016, 4 pages, <http://www.ibm.com/watson/developercloud/tradeoff-analytics.html>.

"Visual Recognition", IBM Watson Developer Cloud, © 2016 IBM, printed Oct. 13, 2016, 6 pages, <http://www.ibm.com/watson/developercloud/visual-recognition.html>.

* cited by examiner

COGNITIVE TRAFFIC SIGNAL CONTROL

BACKGROUND

The present invention relates generally to the field of traffic control, and more particularly to controlling a traffic signal through cognitive computing that incorporates real time data at an intersection.

Traffic lights, also known as traffic signals, traffic lamps, traffic semaphore, signal lights, stop lights, robots, and traffic control signals, are signaling devices positioned at road intersections, pedestrian crossings, and other locations to control flows of traffic. The normal function of traffic lights requires control and coordination to ensure that traffic moves smoothly and safely. Traffic light controls include fixed time control, dynamic control, and adaptive traffic control. Fixed time controls are electro-mechanical signal controllers utilizing dial timers (e.g., cycle gears) with fixed, signalized intersection time plans that sometimes range from 35 seconds to 120 seconds in length and in which the timing does not change throughout the day. Dynamic control or traffic signal preemption uses input from detectors (e.g., in-pavement detectors, non-intrusive detectors, and non-motorized user detection), which are sensors that inform the controller processor whether vehicles or other road users are present, to adjust signal timing and phasing within the limits set by the controller's programming. In-pavement detectors are sensors buried in the road to detect the presence of traffic waiting at the light, that default to a timer when traffic is not present and/or low density. Non-intrusive detectors include video image processors, sensors that use electromagnetic waves, or acoustic sensors to detect the presence of vehicles at the intersection waiting for right of way. Non-motorized user detection is present at some traffic control signals and includes a button that can be pressed to activate the timing system. Coordinated control systems utilize a master controller in which the traffic lights cascade in a sequence such that a vehicle encounters a continuous series of green lights. Adaptive traffic control is a traffic management strategy in which traffic signal timing changes, or adapts, based on actual traffic demand.

Computer vision utilizes computers to gain high-level understanding from digital images or videos. Computer vision encompasses acquiring, processing, analyzing and understanding digital images, and extracts high-dimensional data to produce numerical or symbolic information in the forms of decisions. Sub-domains of computer vision include scene reconstruction, event detection, video tracking, object recognition (i.e. identifying objects in an image or video sequence), object pose estimation, learning, indexing, motion estimation (i.e., transformation from one 2D image to a second 2D image), and image restoration. Object recognition includes appearance based methods and feature based methods. Appearance based methods use example images, templates, or exemplars to perform recognition (e.g., edge matching, divide and conquer search, greyscale matching, gradient matching, histograms, and large model bases, etc.). Feature based methods search for feasible matches between object features and image features by extracting features from objects to be recognized with respect to the searched images (e.g., interpretation trees, hypothesize and test, pose consistency, pose clustering, invariance, geometric hashing, scale invariant feature transform, sped up robust features, etc.).

SUMMARY

Aspects of the present invention disclose a method, computer program product, and system for adapting traffic signal timing, the method comprises one or more computer processors receiving streaming video for one or more paths of a first intersection. The method further comprises one or more computer processors identifying traffic within the received streaming video. The method further comprises one or more computer processors calculating, by one or more computer processors, traffic flow for the one or more paths of the first intersection based on the identified traffic. The method further comprises one or more computer processors determining whether a change in a state of a traffic signal for the first intersection should occur based at least in part on the identified traffic and the determined traffic flow with respect to predefined objectives. Responsive to determining the change in the state of the traffic signal for the first intersection should occur, the method further comprises one or more computer processors calculating a change to a traffic signal timing based on the determined change in the state of the traffic signal for the first intersection. The method further comprises one or more computer processors initiating an adaptation to the traffic signal timing based on the determined change to the traffic signal timing.

DETAILED DESCRIPTION

Embodiments of the present invention recognize that modern traffic lighting systems use detectors (e.g., in-pavement detectors, non-intrusive detectors, and non-motorized user detection) and in some instances may also include video cameras and acoustic detectors to collect information about the state of an intersection. Embodiments of the present invention also recognize that the detectors, video cameras, and acoustic detectors are limited to detecting the presence of objects within an activation zone and do not distinguish different vehicle types, pedestrian types, and/or conditions present at the intersection and/or surrounding intersections that may impact pedestrian flow and/or vehicle traffic at the intersection. Additionally, embodiments of the present invention recognize that while some modern traffic lighting systems are adaptive (i.e., changing in response to traffic conditions), the modern traffic systems are complex, inflexible, and not fully automated.

Embodiments of the present invention monitor and control vehicle traffic and/or pedestrian flow in real time through the use of cameras and object recognition technology. Based on predefined objectives, embodiments of the present invention account for any intersection regardless of a shape, size, and/or configuration, thereby creating flexible and cost effective solutions. Embodiments of the present invention identify variations to vehicle traffic and/or pedestrian flow within camera data (i.e., video images, video feed), and incorporate additional sensor data such as weather sensor data, vehicle sensor data, and/or surrounding intersection data, etc. to provide an accurate depiction of the real time conditions at the intersection. Embodiments of the present invention apply predefined objectives to the real time conditions at the intersection, thereby making decisions that adapt the timing of a cognitive traffic light system to maintain optimal compliance and performance.

Figure 1:
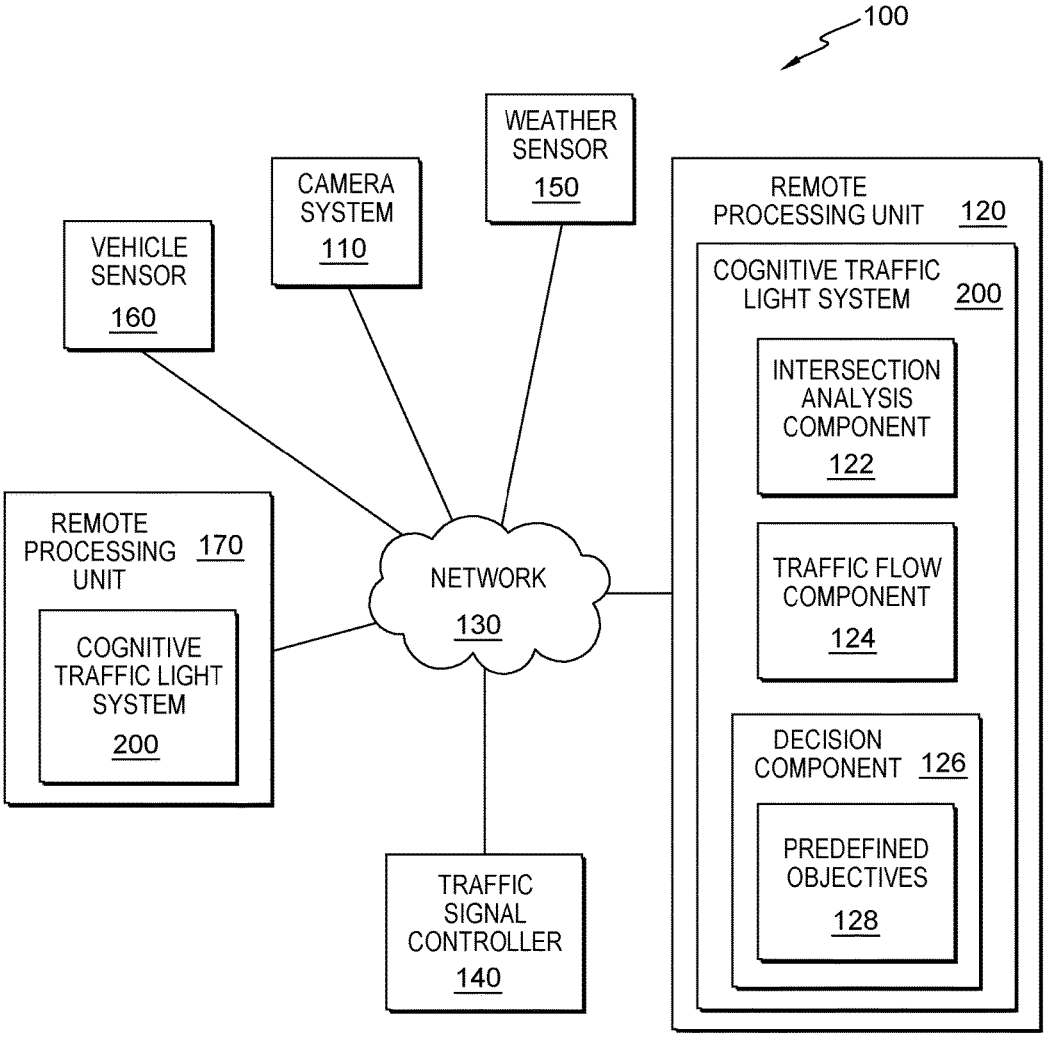
FIG. 1 is a functional block diagram illustrating a cognitive traffic signal control environment, in accordance with an embodiment of the present invention.

The present invention will now be described in detail with reference to the Figures. FIG. 1 is a functional block diagram illustrating a cognitive traffic signal control environment, generally designated 100, in accordance with one embodiment of the present invention. FIG. 1 provides only an illustration of one embodiment and does not imply any limitations with regard to the environments in which different embodiments may be implemented.

In the depicted embodiment, cognitive traffic signal control environment 100 includes camera system 110, remote processing unit 120, and traffic signal controller 140 interconnected over network 130. Cognitive traffic signal control environment 100 may include additional computing devices, mobile computing devices, servers, computers, storage devices, camera systems, remote processing units, traffic signal controllers, or other devices not shown.

Camera system 110 is a video surveillance system utilizing one or more video cameras for electronic motion picture acquisition at an intersection in which a traffic signal is present. In one embodiment, camera system 110 includes one or more cameras that are mounted beside an intersection in a location that provides a view of the entire intersection (e.g., video camera with a wide angle lens). For example, at a T-junction (i.e., three way intersection in which the type of road intersection includes three arms), camera system 110 is placed at the center of the "T" across from the intersecting road, thereby allowing a view of the three paths leading into the intersection with a single camera. In another embodiment, camera system 110 includes one or more cameras that are mounted above the intersection. In some other embodiment, camera system 110 includes separate cameras facing each direction of the paths leading into an intersection. For example, at a four way intersection, camera system 110 includes four separate cameras mounted at the intersection, in which each camera faces outward from the center of the intersection providing a view of oncoming paths to the intersection. Camera system 110 records and sends the camera feed (i.e., video images as streaming video) over network 130 to cognitive traffic light system 200 for analysis, and more specifically to intersection analysis component 122. In the depicted embodiment, camera system 110 is a separate video surveillance system. In another embodiment, camera system 110 is integrated into a traffic signal (not shown) at the intersection.

Remote processing unit 120 may be a management server, a web server, or any other electronic device or computing system capable of receiving and sending data. In some embodiments, remote processing unit 120 may be a laptop computer, a tablet computer, a netbook computer, a personal computer (PC), a desktop computer, a personal digital assistant (PDA), a smart phone, or any programmable device capable of communication with camera system 110, traffic signal controller 140, weather sensor 150, vehicle sensor 160, and remote processing unit 170 over network 130. In other embodiments, remote processing unit 120 may represent a server computing system utilizing multiple computers as a server system, such as in a cloud computing environment. In general, remote processing unit 120 and remote processing unit 170 are representative of any electronic device or combination of electronic devices capable of executing machine readable program instructions as described in greater detail with regard to FIG. 3, in accordance with embodiments of the present invention. Remote processing unit 120 and remote processing unit 170 contain cognitive traffic light system 200. While remote processing unit 170 is the same as remote processing unit 120, remote processing unit 170 is located at a different intersection than remote processing unit 120. Remote processing unit 120 and remote processing unit 170 are related in that vehicle traffic and/or pedestrian flow occurs between remote processing unit 120 and remote processing unit 170. For example, remote processing unit 170 is located at an intersection prior to remote processing unit 120, therefore, at least a portion of vehicle traffic and/or pedestrian flow travels from the location of remote processing unit 170 to the location of remote processing unit 120 and vice versa. Therefore, in some embodiments, remote processing unit 170 and remote processing unit 120 exchange data regarding vehicle traffic and/or pedestrian flow to provide additional information in advance in order to alter the default traffic timing cycle at either intersection.

Network 130 may be a local area network (LAN), a wide area network (WAN) such as the Internet, a wireless local area network (WLAN), any combination thereof, or any combination of connections and protocols that will support communications between camera system 110, remote processing unit 120, traffic signal controller 140, weather sensor 150, vehicle sensor 160, remote processing unit 170, and other computing devices and servers (not shown), in accordance with embodiments of the invention. Network 130 may include wired, wireless, or fiber optic connections.

Traffic signal controller 140 is a microprocessor or computer which monitors and alters the operating conditions of a traffic signal. Traffic signal controller 140 alternates the right of way accorded to vehicles and/or pedestrians by changing and displaying the lights of color (e.g., red, yellow, green) of the traffic signal in a sequence of color phases based on standard timing, and/or receiving input from an additional source (e.g., cognitive traffic light system 200, in-pavement detectors, non-intrusive detectors, non-motorized user detection, etc.) that initiate a change in the timing and conditions of the traffic signal (e.g., red to green, green to yellow, yellow to red). In the depicted embodiment, traffic signal controller 140 is a separate control system. In another embodiment, traffic signal controller 140 may be included within remote processing unit 120. Traffic signal controller 140 receives information from cognitive traffic light system 200 to alter the traffic signal responsive to real time conditions at the intersection.

Weather sensor 150 is a device(s) and/or a service that measures and/or provides information regarding real time weather conditions at a known location. For example, in one embodiment, weather sensor 150 is a thermometer and/or weather station that provides limited weather measurements (e.g., temperature, barometric pressure, wind speeds, and/or precipitation depending on the unit installed) that is located at the intersection. In another example, weather sensor 150 is a service that provides additional weather measurements such as visibility, rate of precipitation, wind chill, heat index, etc., however the measurements are associated with a widespread area (e.g., generalized to an area to which all the weather conditions are applied). Weather sensor 150 provides one of more weather conditions: temperature, wind speed, visibility (e.g., fog, clear, etc.), wind chill, heat index, precipitation (e.g., rain, snow, sleet, hail), as well as other forms of weather measurements that impact conditions encountered by vehicle traffic and/or pedestrian flow. In the depicted embodiment, weather sensor 150 is a weather sensing device that provides weather data to cognitive traffic light system 200 via network 130. In another embodiment, weather sensor 150 may be integrated into remote processing unit 120.

Vehicle sensor 160 is a sensor installed on a vehicle that reports conditions (i.e., data) related to the operation of the vehicle (e.g., anti-lock brake system, electronic stability control, traction control system, tire pressure, speed, etc.), which initiate a vehicle response (e.g., automatic braking system, collisions avoidance, anti-lock brake system, electronic stability control, traction control system etc.) and/or report conditions of the surrounding environment (e.g., external temperature, vehicle detection, global positioning navigation systems etc.). While vehicle sensor 160 reports conditions and/or assist a user (e.g., driver), vehicle sensor 160 also gathers data from on-board diagnostics and built in GPS functionality and delivers the data to remote monitoring services (e.g., telematics). Telematics is an interdisciplinary field that encompasses telecommunications, vehicular technologies, road transportation, road safety, electrical engineering (e.g., sensors, instrumentation, wireless communications, etc.), and computer science (e.g., multimedia, Internet, etc.). Telematics involves sending, receiving and storing information via telecommunication devices, use of telecommunications and informatics for application in vehicles, and global navigation satellite system (GNSS) technology integrated with computers and mobile communications technology in automotive navigation systems. When installed in a vehicle, vehicle sensor 160 sends telematics to cognitive traffic light system 200 for further use in determining vehicle conditions that surround the intersection. In the depicted embodiment, a single instance of vehicle sensor 160 is shown, however, additional instances of vehicle sensor 160 may be included when present at and/or within the coverage area of the intersection and installed. The coverage area is the geographical area covered by cognitive traffic light system 200 (i.e., area in which cognitive traffic light system 200 can receive information from vehicle sensor 160). In an alternate embodiment, cognitive traffic light system 200 receives vehicle sensor data from a remote monitoring service as the vehicle approaches the intersection but is outside of the coverage area.

Cognitive traffic light system 200 is a computer program that receives and analyzes at least streaming video from camera system 110 to identify vehicle traffic and/or pedestrian flow. Cognitive traffic light system 200 adaptively alters the default traffic signal timing based on predefined objectives 128, which cognitive traffic light system 200 applies to the received data in order to maintain efficiency and optimal vehicle traffic and/or pedestrian flow while minimizing delays. In the depicted embodiment, cognitive traffic light system 200 is included within remote processing unit 120. In another embodiment, cognitive traffic light system 200 maybe included within a server or another computing device (not shown). Cognitive traffic light system 200 receives at least camera data (i.e., continuous video images) from camera system 110. In some embodiments, cognitive traffic light system 200 receives additional data from weather sensor 150, vehicle sensor 160, and/or remote processing unit 170 (i.e., surrounding instances of cognitive traffic light system 200 relay upcoming vehicle traffic and/or pedestrian flow from a first intersection that flows into a second intersection to manage traffic flow between and/or at the first and second intersections) in addition to the streaming video. Cognitive traffic light system 200 sends commands to traffic signal controller 140 to adaptively alter the default traffic timing cycle. Cognitive traffic light system 200 includes intersection analysis component 122, traffic flow component 124, and decision component 126.

Intersection analysis component 122 is a program within cognitive traffic light system that utilizes visual recognition software to derive the instantaneous state of the intersection and positions of vehicles and/or pedestrians. Intersection analysis component 122 distinguishes vehicles and pedestrians into sub-categories based on determining a type. For vehicles, intersection analysis component 122 identifies the vehicles as: trucks, cars, busses, emergency vehicles, motorcycles, etc. For pedestrians, intersection analysis component 122 identifies the pedestrians as: adults, children, pedestrians with restricted mobility (e.g., wheel chair, scooter, walker, cane, etc.,) and pedestrians with visual impairments (e.g., service animal, guide cane, etc.) Intersection analysis component 122 provides cognitive traffic light system 200 specific vehicle and/or pedestrian for inclusion in the instantaneous state of the intersection. Upon identification of vehicle and/or pedestrian information, cognitive traffic light system 200 incorporates corresponding objects associated with the identified types of vehicles and/or pedestrians into decision component 126.

Traffic flow component 124 is a program within cognitive traffic light system 200 and utilizes the output of intersection analysis component 122 to measure the throughput of each path through the intersection. Throughput identifies the rate at which vehicle traffic and/or pedestrian flow moves through the intersection. Each path refers to roads, streets, sidewalks, etc. moving in and out of the intersection. Traffic flow component 124 receives the identified vehicles and/or pedestrians from intersection analysis component 122, and tracks the movement of the identified vehicles and/or pedestrians through the intersection. Traffic flow component 124 calculates a set of throughput statistics for utilization by decision component 126. For example, traffic flow component 124 determines the number of total vehicles, the total number of each type of vehicle, the number of total pedestrians, and/or the total number of each type of pedestrian that is able to pass through the intersection within a timing cycle of the traffic signal. Traffic flow component 124 calculates the maximum number of each type of vehicle and/or type of pedestrian that is able to pass through the intersection in a timing cycle of the traffic signal. Based on the throughput statistics, cognitive traffic light system 200 can project future vehicle traffic and/or pedestrian throughput.

For example, traffic flow component 124 determines a tractor-trailer takes thirty seconds to pass through the intersection and a car takes fifteen seconds. Through camera system 110, intersection analysis component 122 identifies a series of two tractor-trailers, five cars, and three additional tractor-trailers. Based on the throughput statistics, cognitive traffic light system 200 calculates the identified sequence would take a total of three minutes and fort-five seconds to fully move through the intersection (e.g. exit). However, cognitive traffic light system 200 identifies the timing cycle of the traffic light to be three minutes, therefore, cognitive traffic light system 200 determines that only the first two tractor-trailers, five cars and possibly the first of the remaining three tractor-trailers will pass through the intersection prior to the traffic signal changing.

Decision component 126 uses cognitive trade analytic software based on the output of traffic flow component 124 and intersection analysis component 122 to determine changes to implement within traffic signal controller 140 to adapt the timing of the traffic signal. Additionally, decision component 126 incorporates information received from weather sensor 150, vehicle sensor 160 and/or remote processing unit 170 to further adapt the timing of the traffic signal based on additional conditions and scenarios outside of traffic conditions. Decision component 126 includes predefined objectives 128 that vary between different intersections and/or additional conditions and scenarios outside of traffic conditions. Predefined objectives 128 are rules that govern vehicle traffic and/or pedestrian flow for an intersection. The number of predefined objectives 128 at an intersection are not limited, and allow multiple rules to govern the intersection that are enacted based upon real time conditions of the intersection. Decision component 126 optimizes predefined objectives 128 at and/or between intersections for varying conditions (e.g., maximize throughput, minimize delays, by vehicle type, by pedestrian type, overall preference for pedestrians, preference for emergency vehicles, weather conditions, vehicle conditions, times of day rush hour, school in session, traffic laws, etc.)

In one embodiment, predefined objectives 128 conflict (i.e., in opposition to, contradict) with another instance of predefined objectives 128 for another path of the intersection. For example, a first instance of predefined objectives 128 is to maximize throughput and a second instance of predefined objectives 128 is to provide pedestrians with the right of way crossing the street for which the first instance of predefined objectives 128 applies. In another embodiment, predefined objectives 128 are consistent (i.e., same, in line, complimentary) with predefined objectives 128 for another path of the intersection. For example, a highway intersects with a low traffic access road. A first instance of predefined objectives 128 for the intersection of the highway and the access road is to maximize throughput of the highway. A second instance of predefined objectives 128 for the intersection of the highway and the access road is the wait time for a vehicle on the access road does not exceed two minutes. Development of predefined objectives 128 for each intersection occur prior to incorporating cognitive traffic signal system 200, however, updates to predefined objectives 128 are available at any time. In one embodiment, upon completing the analysis via decision component 126, cognitive traffic light system 200 initiates a change to traffic light signal controller 140 to alter the traffic signal. In another embodiment, upon completion of the analysis, cognitive traffic light system 200 does not initiate a change to traffic signal controller 140 (i.e., existing timing is consistent with the analysis of predefined objectives 128).

Figure 2:
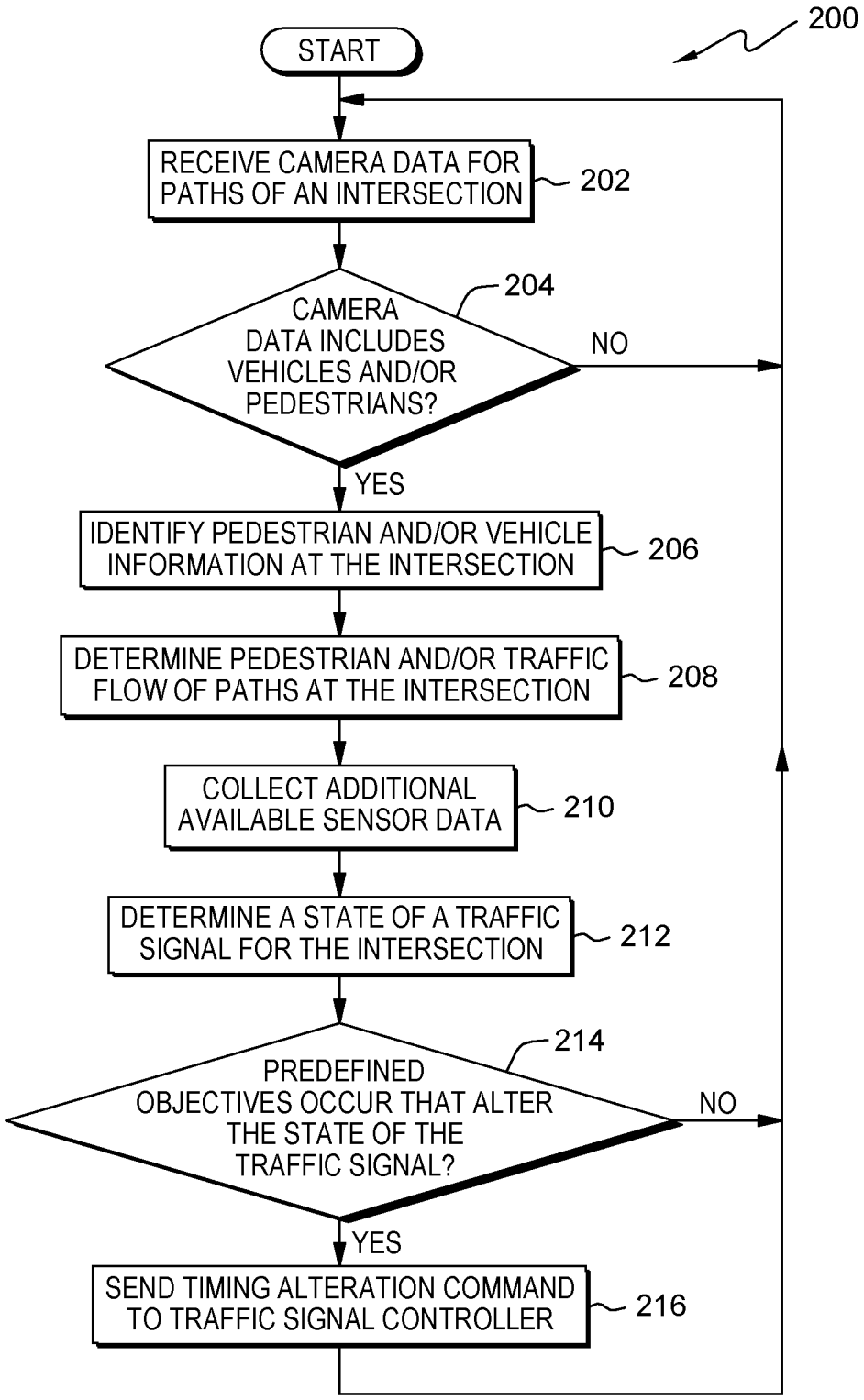
FIG. 2 is a flowchart depicting operational steps of cognitive traffic light system, on a remote processing unit within the cognitive traffic signal control environment of FIG. 1, for monitoring and controlling vehicle traffic and/or pedestrian flow at an intersection, in accordance with an embodiment of the present invention.

FIG. 2 is a flowchart depicting operational steps of cognitive traffic light system 200, a program for monitoring and controlling traffic (e.g., vehicle traffic and/or pedestrian flow) at an intersection, in accordance with an embodiment of the present invention. Traffic includes pedestrians (e.g., pedestrian traffic, pedestrian flow), vehicles (e.g., vehicle traffic), street cars, busses, bicycles, and other conveyances either singly or together, using public and/or private road for the purpose of travel. Traffic is classified by type: heavy motor vehicle (e.g., car, truck, etc.) other vehicle (e.g., moped, bicycle), and pedestrian. Cognitive traffic light system 200 is active (i.e., initiates) at an intersection that includes an operational traffic signal. While cognitive traffic light system 200 is continuously active, cognitive traffic light system 200 waits until intersection analysis component 122 identifies vehicles and/or pedestrians within the camera data prior to performing additional operational steps.

In step 202, cognitive traffic light system 200 receives camera data for paths of an intersection from camera system 110. The camera data is a video feed (e.g., live streaming video) that is a sequence of images processed electronically into an analog or digital format that when displayed with sufficient rapidity create the illusion of motion and continuity. In one embodiment, cognitive traffic light system 200 receives camera data for three or more paths from a single camera. For example, at a T-junction (i.e., three way intersection in which the type of road intersection includes three arms), camera system 110 is placed at the center of the "T" across from the intersecting road, thereby allowing a view of the three paths leading into the intersection with a single camera. In another embodiment, cognitive traffic light system 200 receives camera data for three of more paths from two or more cameras. Prior to sending the camera data to cognitive traffic light system 200, camera system 110 combines the separate camera data (i.e., video feeds) from each camera of camera system 110 into a single combined panoramic video feed, thereby representing the entire intersection.

For example, at a four-way intersection each of the two cameras include a wide angle lens and are installed in positions that encompass two of the paths (i.e., roads) entering the intersection (e.g., combines two separate video feeds). In another example, at another four-way intersection, paths enter the intersection from each compass direction (i.e., north, east, south, and west). From the center of the intersection, four cameras face outward from the center to capture incoming and outgoing vehicle traffic and/or pedestrian traffic from the intersection for each identified direction. While depicted as a single step, cognitive traffic light system 200 receives camera data as a streaming video (i.e., continuous video feed) throughout the operational steps of cognitive traffic light system 200 in order to monitor and adapt to the instantaneous state of the intersection in real-time.

In decision 204, cognitive traffic light system 200 determines whether the camera data includes vehicles and/or pedestrians. Intersection analysis component 122 processes the camera data with visual recognition software. Intersection analysis component 122 evaluates the images within the camera data for objects (e.g., vehicles), faces, and other subjects that provide an indication that vehicle traffic and/or pedestrian flow are present. For example, vehicle traffic and/or pedestrian flow at an intersection is not present and/or sporadic between the hours of 3 and 5 o'clock in the morning, cognitive traffic light system 200 determines the camera data does not include vehicles or pedestrians, and therefore cognitive traffic light system 200 remains in a monitoring state. However, at 5:30 in the morning commuter traffic begins and cognitive traffic light system 200 detects the presence of vehicle traffic and therefore determines that the camera data includes at least vehicles, and proceeds.

If cognitive traffic light system 200 determines the camera data includes vehicles and/or pedestrians (decision 204, yes branch), then cognitive traffic light system 200 identifies pedestrian and/or vehicle information at the intersection (step 206). If cognitive traffic light system 200 determines the camera data does not include vehicles and/or pedestrians (decision 204, no branch), then cognitive traffic light system 200 continues to receive camera data for paths of the intersection (step 202).

In step 206, cognitive traffic light system 200 identifies pedestrian and/or vehicle information at the intersection. Cognitive traffic light system 200 initiates upon detection of vehicle traffic and/or pedestrian flow within the camera data from camera system 110. In some embodiments, intersection analysis component 122 processes the camera data with visual recognition software. In various embodiments, intersection analysis component 122 analyzes the images within the camera data utilizing learning algorithms that through the analysis, identify objects, faces, and other content within the camera data. Intersection analysis component 122 classifies the objects and faces within the camera data based on type. For example, initially, intersection analysis component 122 broadly classifies objects with wheels as vehicles. Intersection analysis component 122 further distinguishes within the vehicles to identify passenger vehicles (e.g., cars, personal trucks, sport utility vehicles, etc.), commercial vehicles (e.g., tractor trailers, dump trucks, garbage trucks, cement trucks, tractors), emergency vehicles (e.g., police cars, ambulances, fire trucks, etc.), public transportation (e.g., busses, trolleys, etc.) motorcycles, bicycles, and additional known forms of motorized and non-motorized transportation. Intersection analysis component 122 further distinguishes within pedestrians to identify adults, children, babies, service animals, individuals with an impairment, etc.

Additionally, in some embodiments, intersection analysis component 122 applies insight and reasoning to determine a deeper meaning and/or context between additional objects (e.g., object that are not pedestrians or vehicles), and pedestrians and/or within the camera data. Intersection analysis component 122 links various object together to form insights (i.e., make conclusions) regarding the conditions of the objects, vehicles, and/or pedestrians and/or the environment based on the content of the camera data. For example, intersection analysis component 122 identifies a stroller with a pedestrian but does not specifically identify the baby as the baby is not visible within the camera data (e.g., covered by the stroller shade). However, intersection analysis component 122 identifies the stroller as a known mode of transportation for a baby, and therefore intersection analysis component 122 determines a baby is also present with the identified pedestrian. In another example, intersection analysis component 122 identifies an opened umbrella with a pedestrian and/or moving windshield wipers on a vehicle. Therefore, intersection analysis component 122 determines precipitation is currently occurring (e.g., raining).

In step 208, cognitive traffic light system 200 determines vehicle traffic and/or pedestrian flow of the paths at the intersection. In various embodiments, intersection analysis component 122 sends the identified vehicles and/or pedestrians to traffic flow component 124 associated with each path for analysis. For example, a four-way intersection includes twelve paths overall for vehicles as a vehicle entering and exiting an intersection from any direction may proceed straight, turn left, or turn right. However, depending on the type of traffic signal (e.g., three lights, three lights with an arrow, etc.), as traffic is stopped in two directions and allowed in the other two directions, a maximum of six possible paths are active at one time. In some embodiments, additional paths within the intersection may also be active, such as turning right on red (e.g., eight possible paths providing a right turn on red is allowed on each road). The four-way intersection also includes eight paths in which the pedestrians interact with vehicle traffic by crossing a street, and four additional paths in which the pedestrian does not cross the street but turns onto the intersecting street at the corner joining the two streets. Traffic flow component 124 identifies and tracks the movement of individual vehicles and pedestrians along the path of the intersection as the vehicles and pedestrians enter and then exit the intersection in order to determine vehicle traffic and pedestrian flow. For example, intersection analysis component 122 identifies a green car entering the intersection on North Street within the camera data from camera system 110 to traffic flow component 124. Traffic flow component 124 tracks the identified green car within the camera data and determines the green car turns left onto West Street as the street which the green car is on changes from North Street to West Street. Therefore, traffic flow component 124 determines the path of the identified green car to be North Street to West Street and calculates the traffic flow for the one car.

In one embodiment, traffic flow component 124 calculates a set of throughput statistics for each path by tracking a total number of vehicles, a total number of each type of vehicle, a total number of pedestrians, and/or a total number of each type of pedestrian that pass through the intersection within the default timing cycle of the traffic signal. In another embodiment, traffic flow component 124 calculates a set of throughput statistics for each path over time (e.g., running average). Over time, the running average normalizes for additional factors such as human response times (i.e., time for a driver and/or pedestrian to identify and respond to the change in the light) and vehicle response times (i.e., amount of time for a vehicle to gain momentum from a full stop). Traffic flow component 124 utilizes the normalized times to improve timing calculations and estimates associated with vehicle traffic and/or pedestrian flow. Additionally, traffic flow component 124 can calculate the maximum number of each type of vehicle and/or type of pedestrian that may pass through the intersection on each path for any length of time such as the default traffic timing cycle (i.e., calculates maximum traffic flow with respect to vehicle traffic and/or pedestrian flow). Traffic flow component 124 passes the throughput statistics to decision component 126.

In step 210, cognitive traffic light system 200 collects additional available sensor data. In one embodiment, cognitive traffic light system 200 collects data from weather sensor 150. In one embodiment, cognitive traffic light system 200 queries a weather service for data associated with a remote instance of weather sensor 150. For example, cognitive traffic light system 200 submits a request for weather data for a zip code, a city, a global position system location associated with the intersection, etc. In response to the query, cognitive traffic light system 200 receives weather conditions (e.g., temperature, precipitation, wind speeds, visibility, etc.) from the weather service for the area. In another embodiment, cognitive traffic light system 200 retrieves data from a locally-installed instance of weather sensor 150 (e.g., a thermometer integrated at the traffic signal). In some other embodiment, cognitive traffic light system 200 receives an external temperature as measured by vehicle sensor 160.

Based on the data from weather sensor 150, cognitive traffic light system 200 sets fair weather and foul weather flags for the identified vehicle types and/or pedestrian types. For example, data from weather sensor 150 indicates a sunny day with no precipitation but a negative wind chill factor (i.e., perceived decrease in air temperature felt by the body on exposed skin due to the flow of air). Therefore, cognitive traffic light system 200 sets a weather flag for a passenger vehicle to fair weather (e.g., road conditions are good, driver is not exposed to negative wind chill), a weather flag for a motorcycle to foul weather (e.g., while road conditions are good, motorcyclist is exposed to negative wind chill), and a weather flag associated with a pedestrian to foul weather (e.g., pedestrian exposed to negative wind chill). Cognitive traffic light system 200 incorporates data from weather sensor 150 into decision component 126 for utilization with weather specific instances of predefined objectives 128.

In another embodiment, cognitive traffic light system 200 collects data from vehicle sensor 160 for vehicles that allow telematics. Telematics involves sending, receiving and storing information via telecommunication devices, use of telecommunications and informatics for application in vehicles, and global navigation satellite system (GNSS) technology integrated with computers and mobile communications technology in automotive navigation systems. Cognitive traffic light system 200 collects data from vehicle sensor 160 associated with at least braking and traction control systems. For example, cognitive traffic light system 200 receives data that identifies initiation and/or engagement of: an anti-lock braking system (i.e., allows wheels on a motor vehicle to maintain tractive contact with the road surface according to driver inputs while braking, preventing the wheels from ceasing rotation and avoiding uncontrolled skidding), automatic braking system (e.g., sense and avoid an imminent collision with another vehicle, person or obstacle by braking without any driver input), and traction control system (e.g., identifies a loss of road grip that compromises steering control and stability of vehicles). Additionally, in some embodiments, cognitive traffic light system 200 may also receive a temperature from vehicle sensor 160. Cognitive traffic light system 200 incorporates data from vehicle sensor 160 into decision component 126 for utilization with vehicle specific instances of predefined objectives 128 that may result in an adaptation of the timing of the traffic signal. For example, cognitive traffic light system 200 receives information from vehicle sensor 160 that indicates a loss of traction. Cognitive traffic light system 200 incorporates data from vehicle sensor 160 and may alter the speed at which the traffic light changes to green on the stopped path only, which temporarily delays the start of motion on the stopped path in order to potentially avoid a collision in the event the vehicle is unable to stop prior to entering the intersection.

In some other embodiment, cognitive traffic light system 200 collects data from additional instances of cognitive traffic light system 200 for intersections that share vehicle traffic and/or pedestrian flow (e.g., remote processing unit 170). Cognitive traffic light system 200 queries additional instances of cognitive traffic light system 200 (e.g., remote processing unit 170) for path data that corresponds with incoming paths to the current instance of cognitive traffic light system 200. For example, a first intersection joins Main Street and First Street, a second intersection joins Main Street and Second Avenue. Cognitive traffic light system 200 at the intersection of Main Street and Second Avenue, queries the instance of cognitive traffic light system 200 at the intersection of Main Street and First Street for the throughput of vehicle traffic and pedestrian flow for the path moving from the intersection of Main Street and First Street to the intersection of Main Street and Second Avenue. The throughput vehicle traffic and/or pedestrian flow includes a combination of vehicles and/or pedestrians: turning right and left off of First Street heading towards the intersection of Main Street and Second Avenue, and continuing straight towards the intersection of Main Street and Second Avenue (i.e., includes all pedestrian flow and/or vehicle traffic moving from the first intersection to the second intersection and the converse). By receiving the information in advance, cognitive traffic light system 200 receives notifications of incoming vehicle traffic and/or pedestrian flow conditions that may result in an adaptation of the default traffic timing cycle of the traffic signal at the second intersection. In yet some other embodiments, cognitive traffic light system 200 collects additional available sensor data from one or more of the aforementioned sensors for utilization by decision component 126.

In step 212, cognitive traffic light system 200 determines a state of a traffic signal for the intersection. Cognitive traffic light system applies predefined objectives 128 to the results of intersection analysis component 122 and traffic flow component 124 to determine the state of the traffic signal. Predefined objectives 128 are rules that govern the manner in which vehicle traffic and/or pedestrian flow occurs at the intersection. In one embodiment, decision component 126 receives the throughput statistics from traffic flow component 124 and applies predefined objectives 128. For example, the intersection analysis component 122 identifies a state road with a high throughput, and a secondary road that intersects with the state road with a low throughput. The predefined set of objectives state that the throughput for the state road should be maximized but the secondary road should not wait longer than two minutes before continuing. Intersection analysis component 122 identifies a passenger vehicle waiting on the access road and begins the two minute timer at the time the first passenger vehicle arrives at the intersection on the secondary road. Prior to the two minutes expiring, two additional passenger vehicles join the first passenger vehicle on the access road. After one minute, cognitive traffic light system 200 detects a break in the vehicle traffic on the main road and projects the break to be at least one minute in length. At the rate of 15 seconds per passenger vehicle, cognitive traffic light system 200 calculates the three vehicles can clear the intersection in 45 seconds. Cognitive traffic light system 200 determines the state of traffic light changes in favor of the secondary road prior to the two minute maximum to take advantage of the one minute break in traffic on the state road. Cognitive traffic light system 200 reinstates the green light on the state road twenty seconds after the last of the three passenger vehicle clears the intersection to minimize the wait time of vehicle flow and maximize overall throughput on the state road.

In another example, intersection analysis component 122 detects a fire truck with flashing lights and identifies the fire truck as an emergency vehicle. Decision component 126 implements an emergency instance of predefined objectives 128 which gives precedence to the fire truck over remaining instances of predefined objectives 128. As the ultimate direction of the fire truck is unknown (i.e., fire truck could go left, right, or straight at the intersection), decision component 126 determines the state of all paths is red, thereby enacting an emergency vehicle right of way which also corresponds with known traffic laws. Intersection analysis component 122 identifies the path on which the fire truck passes through the intersection via camera system 110 and cognitive traffic light system 200 sends an incoming emergency vehicle alert and a rate of travel (e.g., speed) to remote processing unit 170 for processing, in order for remote processing unit 170 to prepare for the arrival of the fire truck at the next intersection in advance.

In yet another example, intersection analysis component 122 detects that a pedestrian entered the intersection while crossing was allowed, and is supported by a set of crutches while having one foot raised above the ground. Intersection analysis component 122 determines that the crutches and posture of the pedestrian indicate the presence of an injury in the pedestrian. However, through intersection analysis component 122 and traffic flow component 124, cognitive traffic light system 200 determines a rate of travel (i.e., speed, tracks the distance traveled with respect to time) for the pedestrian with the crutches to be slower than the average rate of travel for a pedestrian without crutches. Based on the slower rate of travel for the pedestrian with crutches, cognitive traffic light system 200 calculates the pedestrian with the crutches will remain in the crosswalk for an additional five seconds after the traffic signal changes. Decision component 126 implements a personal safety instance of predefined objectives 128 which determines a delay to the change of state of the traffic light to allow for the pedestrian with crutches to safely cross and exit the crosswalk without incurring a risk of oncoming vehicle traffic.

In another embodiment, in addition to the throughput statistics, decision component 126 receives data from weather sensor 150. Decision component 126 evaluates the data from weather sensor 150 in conjunction with the throughout statistics to determine a state of the traffic light. For example, data from weather sensor 150 reports a temperature of 92 degrees Fahrenheit and a relative humidity of 65 percent for a heat index (i.e., combination of air temperature and relative humidity) equal to 108 degrees Fahrenheit, which is associated with a danger condition and pedestrians should limit exposure. Based on the heat index, cognitive traffic light system 200 sets the foul weather flag for pedestrians, and the fair weather flag for vehicles. Intersection analysis component 122 identifies a pedestrian reaches the intersection at the beginning of a three minute cycle. Decision component 126 raises the priority of the pedestrian within the predefined set of objectives, and determines the state and timing of the traffic light to favor the pedestrian in order to minimize the pedestrian's exposure to the high heat index.

In another example, weather sensor 150 identifies rain and a rainfall rate that is conducive to hydroplaning (i.e., a loss of steering or braking control when a layer of water prevents direct contact between tires and the road). Cognitive traffic light system 200 sets both the vehicle weather flag and pedestrian weather flag to foul. Decision component 126 evaluates the foul flag settings with respect to predefined objectives 128 and changes the color transition time for the traffic light, thereby increasing the time the traffic signal stays yellow (e.g., initiates change fifteen seconds early, thereby increasing the transition time to forty-five seconds from thirty) for the moving traffic, in order to allow additional time for stopping due to the weather conditions, while not impacting the overall vehicle traffic (i.e., does not alter default traffic timing cycle). Additionally, decision component 126 utilizes a foul weather instance of predefined objectives 128 when intersection analysis component 122 identifies a pedestrian is present to decrease the time the pedestrian is waiting in the rain prior to crossing the intersection.

In another embodiment in addition to the throughput statistics, decision component 126 receives data from vehicle sensor 160. Decision component 126 evaluates the data from vehicle sensor 160 in conjunction with the throughput statistics to determine a state of the traffic light. For example, cognitive traffic light system 200 receives data that identifies initiation of an anti-lock braking and identifies loss of traction control in a vehicle approaching a yellow traffic light. Decision component 126 determines that based on the speed of the vehicle as calculated though intersection analysis component 122 the vehicle may not stop prior to the traffic light providing a green indication for the intersecting street. Therefore, based on predefined objectives 128, decision component 126 alters the state of the traffic signal for the intersecting street only, and delays the change to green causing the traffic signal to remain red until one of the following occurs: the vehicle comes to a stop prior to the intersection, or the vehicle passes through the intersection.

In another embodiment, in addition to the throughput statistics for remote processing unit 120, decision component 126 receives throughput statistics from remote processing unit 170. For example, a traffic light associated with remote processing unit 120 is scheduled to change after three minutes with a 30 second delay between colors. Traffic has been flowing for two and a half minutes and intersection analysis component 122 identifies an ongoing line of cars that will exceed the allotted time of three minutes. Intersection analysis component 122 does not detect a vehicle and/or pedestrian waiting at the traffic light in the opposite non-flowing traffic direction, however, remote processing unit 170 identifies a vehicle on the path moving toward remote processing unit 120. Remote processing unit 170 calculates an arrival of the vehicle at remote processing unit 120 to occur in one minute and thirty seconds based on the current rate of travel (e.g., speed). Decision component 126 determines traffic can continue to flow for an additional thirty seconds in the current direction (i.e., extends the time to 3 minutes 30 seconds), and maintains the transitional delay of thirty seconds. By extending the time, cognitive traffic light system 200 allows more vehicles to pass through the intersection (i.e., improves the flow of traffic), while still turning the traffic signal to green in time for the approaching vehicle to pass with minimal to no impact on travel time.

In some embodiments, decision component 126 analyzes a combination of one or more the aforementioned embodiments (e.g., type of vehicle, types of pedestrians, data from weather sensor 150, data from vehicle sensor 160, and/or throughput statistics from remote processing unit 170) with respect to predefined objectives 128. Based on the analysis of the aforementioned embodiments with respect to predefined objectives 128, decision components 126 determines the state (e.g., color of the traffic light) and rates of change associated with the traffic signal.

In decision 214, cognitive traffic light system 200 determines whether predefined objectives 128 occur that alter the state of the traffic signal (i.e., result in a change to the timing of the lights). Cognitive traffic light system 200 calculates a length of time for traffic movement (e.g., green light), traffic stoppage (e.g., red light), and transition times (e.g., yellow light) for the paths of intersection based on one or more of the aforementioned inputs to the intersection (e.g., traffic flow, pedestrian flow, type of vehicles, type of pedestrians, weather sensor 150, vehicle sensor 160, etc.) with respect to the predefined rules. Cognitive traffic light system 200 compares current traffic signal timing with the calculated traffic signal timing. Additionally, cognitive traffic light system 200 compares a current state of the traffic signal with the determined state of the traffic signal. For example, cognitive traffic light system determines the state of the traffic signal should be green (e.g., allows traffic to flow) for traffic traveling on Main Street, and red (e.g., does not allow traffic to flow) on the access road. Cognitive traffic light system 200 retrieves the current state of the traffic signal (i.e., receives the information that identifies which street traffic includes flowing traffic, and which street includes stopped traffic, timing cycles, and elapsed time within the timing cycles). Based on the results of the comparison with respect to the predefined objectives, cognitive traffic light system 200 determines whether changes should occur to alter the state of the traffic signal.

In one embodiment, cognitive traffic light system 200 determines to alter the state of the traffic signal by lengthen the current timing (i.e., calculates a longer time interval for the traffic signal and increases the timing associated with the green cycle on the moving path, and increases the timing of the red cycle associated with the stopped path). For example, a primary instance of predefined objectives 128 states to maximize throughput on Main Street, and a secondary instance of predefined objectives 128 states that vehicle traffic on the access road should not wait longer than two minutes. The default traffic timing cycle switches from Main Street to the access road after three minutes, and switches from the access road to Main Street after one minute. However, intersection analysis component 122 does not identify a vehicle on the access road. Therefore, decision component 126 determines only the primary instance of predefined objectives 128 occurs, and extends (e.g., lengthens) the state and timing of the traffic signal to maximize vehicle traffic on Main Street, until the secondary instance of predefined objectives 128 occurs (i.e., intersection analysis component 122 detects a vehicle on the access road.). Upon occurrence of the second instance of predefined objectives 128, cognitive traffic light system 200 through decision component 126 determines an additional change such as to alter the state of the traffic signal after a two minute maximum wait, identify an earlier opportunity to change the state of the traffic signal due to a break in the traffic flow on Main Street, and/or reinstitute the default traffic timing cycle which changes once three minutes expire.

In another embodiment, cognitive traffic light system 200 determines to alter the state of the traffic signal by shortening the default traffic timing cycle (i.e., calculates a shortened timing cycle and reduces the timing of the traffic signal and changes the colors at a faster rate). Continuing the example, an additional instance of predefined objectives 128 states that a pedestrian in foul weather should not wait longer than one minute prior to being able to cross the intersection. Data from weather sensor 150 identifies a negative wind chill, and cognitive traffic light system 200 sets the pedestrian foul weather flag. One minute into the three minute cycle for Main Street, intersection analysis component 122 identifies a pedestrian waiting to cross Main Street. Cognitive traffic light system 200 determines the current timing will exceed the one minute maximum wait time for the pedestrian, and shortens the timing cycle, indicating a change in state of the traffic signal in favor of the pedestrian.

In some other embodiment, cognitive traffic light system determines that the current timing of the traffic light setting meets predefined objectives 128, and cognitive traffic light system 200 does not alter the default traffic timing cycle (i.e., traffic signal controller 140 maintains and changes the traffic signal based on the default traffic timing cycle). For example, vehicle traffic is flowing on Main Street for a two and a half minutes prior to intersection analysis component 122 identifying a vehicle approaching the intersection. Decision component 126 determines the second instance of predefined objectives 128 will not be violated and maintains the default traffic timing cycle (e.g., vehicle on access road waits for approximately thirty seconds prior to the traffic light changing the right of way from Main Street to the access road).

If cognitive traffic light system 200 determines that predefined objectives 128 occur that alter the state of the traffic signal (decision 214, yes branch), then cognitive traffic light system 200 sends a timing alteration command to traffic signal controller 140 (i.e., changes the state of the traffic signal) (step 216). If cognitive traffic light system 200 does not determine predefined objectives 128 occur that alter the state of the traffic signal (decision 214, no branch), then cognitive traffic light system 200 returns to receive camera data for paths of the intersection (step 202).

In step 216, cognitive traffic light system 200 sends a timing alteration command to traffic signal controller 140. In one embodiment, cognitive traffic light system 200 sends a single timing alteration command to traffic signal controller 140, after which the default traffic timing cycle resumes. In another embodiment, cognitive traffic light system 200 sends a temporary timing alteration command to traffic signal controller 140, thereby, altering traffic signal controller 140 for multiple default traffic timing cycles For example, the access road to Main Street closes due to a water main break. Intersection analysis component 122 identifies a barricade blocking a road with a sign stating "Road Closed—Water Main Break". Decision component 126 determines that vehicle traffic on the access road is prohibited until removal of the barricade, deems the second instance of predefined objectives 128 to be temporarily invalid, and determines that resolution of the water main break will exceed more than a single cycle of the default traffic timing cycle. Therefore, decision component 126 maximizes vehicle traffic on Main Street and allows the traffic signal to remain green until intersection analysis component 122 identifies removal of the barricade, and decision component 126 reinstitutes the second instance of predefined objectives 128. In some other embodiment, cognitive traffic light system 200 sends a timing alteration command to permanently alter the default traffic timing cycle. For example over time, decision component 126 identifies traffic on Main Street moves for at least five minutes prior to intersection analysis component 122 detecting a vehicle on the access road. Therefore, decision component 126 extends the default traffic timing cycle to match the actual occurrences of vehicle flow at the intersection.

Figure 3:
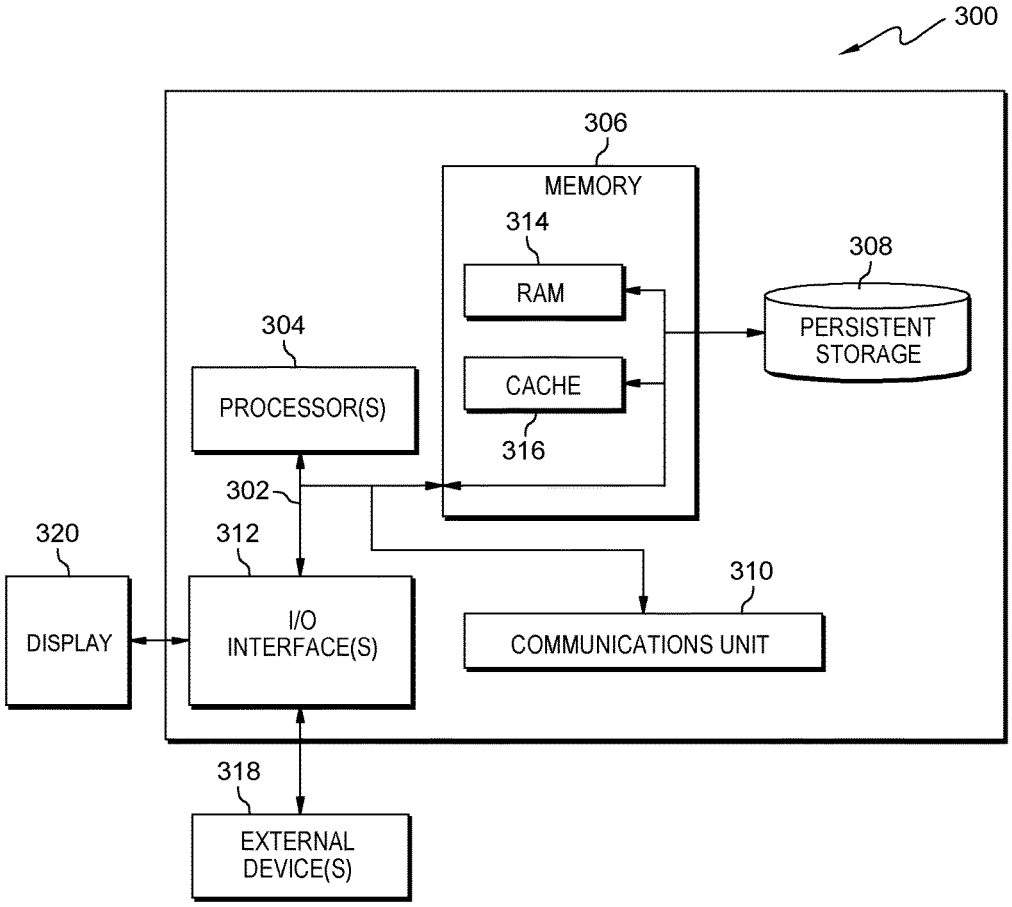
FIG. 3 is a block diagram of components of the remote processing unit executing the cognitive traffic light system, in accordance with an embodiment of the present invention.

FIG. 3 depicts a block diagram of components of remote processing unit 300 in accordance with an illustrative embodiment of the present invention. It should be appreciated that FIG. 3 provides only an illustration of one implementation and does not imply any limitations with regard to the environments in which different embodiments may be implemented. Many modifications to the depicted environment may be made.

Remote processing unit 300 includes communications fabric 302, which provides communications between cache 316, memory 306, persistent storage 308, communications unit 310, and input/output (I/O) interface(s) 312. Communications fabric 302 can be implemented with any architecture designed for passing data and/or control information between processors (such as microprocessors, communications and network processors, etc.), system memory, peripheral devices, and any other hardware components within a system. For example, communications fabric 302 can be implemented with one or more buses or a crossbar switch.

Memory 306 and persistent storage 308 are computer readable storage media. In this embodiment, memory 306 includes random access memory (RAM) 314. In general, memory 306 can include any suitable volatile or non-volatile computer readable storage media. Cache 316 is a fast memory that enhances the performance of computer processor(s) 304 by holding recently accessed data, and data near accessed data, from memory 306.

Cognitive traffic light system 200, intersection analysis component 122, traffic flow component 124, decision component 126, and predefined objectives 128 may be stored in persistent storage 308 and in memory 306 for execution and/or access by one or more of the respective computer processor(s) 304 via cache 316. In an embodiment, persistent storage 308 includes a magnetic hard disk drive. Alternatively, or in addition to a magnetic hard disk drive, persistent storage 308 can include a solid-state hard drive, a semiconductor storage device, a read-only memory (ROM), an erasable programmable read-only memory (EPROM), a flash memory, or any other computer readable storage media that is capable of storing program instructions or digital information.

The media used by persistent storage 308 may also be removable. For example, a removable hard drive may be used for persistent storage 308. Other examples include optical and magnetic disks, thumb drives, and smart cards that are inserted into a drive for transfer onto another computer readable storage medium that is also part of persistent storage 308.

Communications unit 310, in these examples, provides for communications with other data processing systems or devices. In these examples, communications unit 310 includes one or more network interface cards. Communications unit 310 may provide communications through the use of either or both physical and wireless communications links. Cognitive traffic light system 200, intersection analysis component 122, traffic flow component 124, decision component 126, and predefined objectives 128 may be downloaded to persistent storage 308 through communications unit 310.

I/O interface(s) 312 allows for input and output of data with other devices that may be connected to remote processing unit 300. For example, I/O interface(s) 312 may provide a connection to external device(s) 318, such as a keyboard, a keypad, a touch screen, and/or some other suitable input device. External devices 318 can also include portable computer readable storage media such as, for example, thumb drives, portable optical or magnetic disks, and memory cards. Software and data used to practice embodiments of the present invention, e.g., cognitive traffic light system 200, intersection analysis component 122, traffic flow component 124, decision component 126, and predefined objectives 128, can be stored on such portable computer readable storage media and can be loaded onto persistent storage 308 via I/O interface(s) 312. I/O interface(s) 312 also connect to a display 320.

Display 320 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A method for adapting traffic signal timing, the method comprising:

receiving, by one or more computer processors, streaming video for one or more paths of a first intersection;

identifying, by one or more computer processors, traffic within the received streaming video;

calculating, by one or more computer processors, traffic flow for the one or more paths of the first intersection based on the identified traffic;

determining, by one or more computer processors, whether a change in a state of a traffic signal for the first intersection should occur based at least in part on the identified traffic and the calculated traffic flow with respect to predefined objectives;

responsive to determining that the change in the state of the traffic signal for the first intersection should occur, calculating, by one or more computer processors, a change to a traffic signal timing based on the determined change in the state of the traffic signal for the first intersection; and initiating, by one or more computer processors, an adaptation to the traffic signal timing based on the calculated change to the traffic signal timing.

2. The method of claim 1, further comprising:

collecting, by one or more computer processors, sensor data associated with the first intersection;

evaluating, by one or more computer processors, the collected sensor data with respect to the predefined objectives; and determining, by one or more computer processors, additional changes to the calculated traffic signal timing based on the evaluated collected sensor data.

3. The method of claim 2, wherein the collected sensor data associated with the first intersection includes one or more of the following:

weather sensor data that identifies at least a temperature associated with the first intersection;

vehicle sensor data that identifies at least information associated with braking and traction control systems associated with the first intersection; and data for a second intersection that identifies a traffic flow from the second intersection in which the traffic flow from the second intersection moves into the first intersection.

4. The method of claim 1, wherein identifying the traffic within the received streaming video further comprises:

identifying, by one or more computer processors, vehicles within the received streaming video; and identifying, by one or more computer processors, a type of each individual vehicle within the identified vehicles.

5. The method of claim 1, wherein identifying the traffic within the received streaming video further comprises:

identifying, by one or more computer processors, pedestrians within the received streaming video; and identifying, by one or more computer processors, a type of each individual pedestrian within the identified pedestrians.

6. The method of claim 1, wherein determining whether a change in the state of a traffic signal for the first intersection should occur based at least in part on the identified traffic and the calculated traffic flow with respect to predefined objectives further comprises:

evaluating, by one or more computer processors, the identified traffic with respect to the predefined objectives; and evaluating, by one or more computer processors, the determined traffic flow with respect to the predefined objectives.

7. The method of claim 1, wherein calculating the change to the traffic signal timing based on the determined state of the traffic signal for the first intersection further comprises:

comparing, by one or more computer processors, the determined state of the traffic signal for the first intersection to a current state of the traffic signal;

determining, by one or more computer processors, whether the determined state of the traffic signal for the first intersection and the current state of the traffic signal for the first intersection are different based on the comparison; and responsive to determining the determined state of the traffic signal for the first intersection and the current state of the traffic signal for the first intersection are different, updating, by one or more computer processors, the current state of the traffic signal for the first intersection with the determined state for the first intersection.

8. The method of claim 1, wherein calculating the traffic flow for the one or more paths of the first intersection based on the identified traffic further comprises:

tracking, by one or more computer processors, movement of the identified traffic along the one or more paths of the first intersection;

calculating, by one or more computer processors, a set of throughput statistics for each of the one or more paths of the first intersection based on the tracked movement of the identified traffic; and calculating, by one or more computer processors, an amount of traffic to pass through the first intersection based at least in part on the calculated set of throughput statistics and the identified traffic.

9. A computer program product for adapting traffic signal timing, the computer program product comprising:

one or more computer readable storage media and program instructions stored on the one or more computer readable storage media, the program instructions comprising:

program instructions to receive streaming video for one or more paths of a first intersection;

program instructions to identify traffic within the received streaming video;

program instructions to calculate traffic flow for the one or more paths of the first intersection based on the identified traffic;

program instructions to determine whether a change in a state of a traffic signal for the first intersection should occur based at least in part on the identified traffic and the calculated traffic flow with respect to predefined objectives;

responsive to determining that the change in the state of the traffic signal for the first intersection should occur, program instructions to calculate a change to a traffic signal timing based on the determined change in the state of the traffic signal for the first intersection; and program instructions to initiate an adaptation to the traffic signal timing based on the calculated change to the traffic signal timing.

10. The computer program product of claim 9, further comprising program instructions, stored on the one or more computer readable storage media, to:

collect sensor data associated with the first intersection;

evaluate the collected sensor data with respect to the predefined objectives; and determine additional changes to the calculated traffic signal timing based on the evaluated collected sensor data.

11. The computer program product of claim 10, wherein the collected sensor data associated with the first intersection includes one or more of the following:

weather sensor data that identifies at least a temperature associated with the first intersection;

vehicle sensor data that identifies at least information associated with braking and traction control systems associated with the first intersection; and data for a second intersection that identifies a traffic flow from the second intersection in which the traffic flow from the second intersection moves into the first intersection.

12. The computer program product of claim 9, wherein to identify the traffic within the received streaming video further comprises program instructions, stored on the one or more computer readable storage media, to:

identify vehicles within the received streaming video; and identify a type of each individual vehicle within the identified vehicles.

13. The computer program product of claim 9, wherein to identify the traffic within the received streaming video further comprises program instructions, stored on the one or more computer readable storage media, to:

identify pedestrians within the received streaming video; and identify a type of each individual pedestrian within the identified pedestrians.

14. The computer program product of claim 9, wherein to determine whether a change in the state of a traffic signal for the first intersection should occur based at least in part on the identified traffic and the calculated traffic flow with respect to predefined objectives further comprises program instructions, stored on the one or more computer readable storage media, to:

evaluate the identified traffic with respect to the predefined objectives; and evaluate the determined traffic flow with respect to the predefined objectives.

15. The computer program product of claim 9, wherein to calculate the change to the traffic signal timing based on the determined state of the traffic signal for the first intersection further comprises program instructions, stored on the one or more computer readable storage media, to:

compare the determined state of the traffic signal for the first intersection to a current state of the traffic signal;

determine whether the determined state of the traffic signal for the first intersection and the current state of the traffic signal for the first intersection are different based on the comparison; and responsive to determining the determined state of the traffic signal for the first intersection and the current state of the traffic signal for the first intersection are different, update the current state of the traffic signal for the first intersection with the determined state for the first intersection.

16. The computer program product of claim 9, wherein to calculate the traffic flow for the one or more paths of the first intersection based on the identified traffic further comprises program instructions, stored on the one or more computer readable storage media, to:

track movement of the identified traffic along the one or more paths of the first intersection;

calculate a set of throughput statistics for each of the one or more paths of the first intersection based on the tracked movement of the identified traffic; and calculate an amount of traffic to pass through the first intersection based at least in part on the calculated set of throughput statistics and the identified traffic.

17. A computer system for adapting traffic signal timing, the computer system comprising:

one or more computer processors, one or more computer readable storage media, and program instructions stored on the computer readable storage media for execution by at least one of the one or more processors, the program instructions comprising:

program instructions to receive streaming video for one or more paths of a first intersection;

program instructions to identify traffic within the received streaming video;

program instructions to calculate traffic flow for the one or more paths of the first intersection based on the identified traffic;

program instructions to determine whether a change in a state of a traffic signal for the first intersection should occur based at least in part on the identified traffic and the calculated traffic flow with respect to predefined objectives;

responsive to determining that the change in the state of the traffic signal for the first intersection should occur, program instructions to calculate a change to a traffic signal timing based on the determined change in the state of the traffic signal for the first intersection; and program instructions to initiate an adaptation to the traffic signal timing based on the calculated change to the traffic signal timing.

18. The computer system of claim 17, further comprising program instructions, stored on the one or more computer readable storage media for execution by at least one of the one or more computer processors, to:

collect sensor data associated with the first intersection;

evaluate the collected sensor data with respect to the predefined objectives; and determine additional changes to the calculated traffic signal timing based on the evaluated collected sensor data.

19. The computer system of claim 17, wherein to calculate the change to the traffic signal timing based on the determined state of the traffic signal for the first intersection further comprises program instructions, stored on the one or more computer readable storage media for execution by at least one of the one or more computer processors, to:

compare the determined state of the traffic signal for the first intersection to a current state of the traffic signal;

determine whether the determined state of the traffic signal for the first intersection and the current state of the traffic signal for the first intersection are different based on the comparison; and responsive to determining the determined state of the traffic signal for the first intersection and the current state of the traffic signal for the first intersection are different, determine to update the current state of the traffic signal for the first intersection with the determined state for the first intersection.

20. The computer system of claim 17, wherein to calculate the traffic flow for the one or more paths of the first intersection based on the identified traffic further comprises program instructions, stored on the one or more computer readable storage media for execution by at least one of the one or more computer processors, to:

track movement of the identified traffic along the one or more paths of the first intersection;

calculate a set of throughput statistics for each of the one or more paths of the first intersection based on the tracked movement of the identified traffic; and calculate an amount of traffic to pass through the first intersection based at least in part on the calculated set of throughput statistics and the identified traffic.

* * * * *